US010317026B1

(12) United States Patent
Jao

(10) Patent No.: US 10,317,026 B1
(45) Date of Patent: Jun. 11, 2019

(54) NIGHTLIGHT

(71) Applicant: Yuan-Chang Jao, Zaoqiao Township, Miaoli County (TW)

(72) Inventor: Yuan-Chang Jao, Zaoqiao Township, Miaoli County (TW)

( * ) Notice: Subject to any disclaimer, the term of this patent is extended or adjusted under 35 U.S.C. 154(b) by 0 days.

(21) Appl. No.: 15/835,902

(22) Filed: Dec. 8, 2017

(51) Int. Cl.
*F21S 8/00* (2006.01)
*F21V 14/08* (2006.01)
*F21V 21/30* (2006.01)

(52) U.S. Cl.
CPC ..... *F21S 8/035* (2013.01); *F21V 14/08* (2013.01); *F21V 21/30* (2013.01)

(58) Field of Classification Search
CPC ..... F21S 8/035
USPC ..... 362/644, 277, 253, 297
See application file for complete search history.

(56) References Cited

U.S. PATENT DOCUMENTS

| | | | | |
|---|---|---|---|---|
| 7,871,192 | B2 | 1/2011 | Chien | |
| 2015/0070938 | A1* | 3/2015 | Chien | F21S 9/02 362/644 |
| 2016/0313636 | A1* | 10/2016 | Chien | G03B 29/00 |
| 2017/0059132 | A1* | 3/2017 | Chien | F21V 29/20 |
| 2018/0231199 | A1* | 8/2018 | Chien | F21V 21/08 |
| 2018/0274777 | A1* | 9/2018 | Torrez | F21V 33/004 |

* cited by examiner

*Primary Examiner* — Allyson N Trail
(74) *Attorney, Agent, or Firm* — Muncy, Geissler, Olds & Lowe, P.C.

(57) ABSTRACT

A nightlight is revealed. The nightlight includes a support, a plug, a housing, a bent tube, at least one light emitting diode (LED) and a wire. The bent tube consists of an upper segment, a lower segment and a middle segment connected to each other and having a central axis. A reflective lens is arranged at the middle segment and a LED slot is disposed on an opening of the lower segment for mounting the LED. At least one pattern plate and a projection lens set are mounted in the bent tube. Light emitted from the LED is moved along the central axis of the bent tube and passed through the projection lens set, the pattern plate and the reflective lens to be projected outward. Thus the light with the pattern is projected at an angle by rotating the housing of the nightlight.

10 Claims, 8 Drawing Sheets

NIGHTLIGHT

BACKGROUND OF THE INVENTION

The present invention relates to a nightlight, especially to a nightlight that includes a bent tube built-in with at least one pattern plate and at least one LED for projecting light with specific patterns.

There are many adorable nightlights on the market nowadays and consumers care about product appearance or light function. Refer to U.S. Pat. No. 7,871,192 "LED NIGHT LIGHT HAS PROJECTION OR IMAGE FEATURE", an LED night light for night time or dark area is revealed. A rotatable slides-disc (3*g*) with a plurality of slides (3*k*),(3*k*'), (3*k*") is revealed in FIG. 3 and at least one telescoping optics-means 4*c* is combined with the LED 4*d* and slides (not shown) and other components to form a tube that is mounted on a rotatable sealing housing. Openings (4*e*) on the tube are disposed with a projection lens element that is at one end of the sealed housing and the LED is at another end of the sealed housing. However, as shown in FIG. 4, a circuit means (4*b*), (4*f*), (4*g*), (4*h*), (4*i*) such as a circuit board, conductive means, etc., is arranged to work with the LED 4*d* for providing light functions. The circuit means is extended into a bottom end inside the rotatable sealed housing through a plug. The rotatable sealed housing is often rotated while the nightlight is in use. Thus the circuit means (4*b*), (4*f*), (4*g*), (4*h*), (4*i*)/conductive means are easy to be pulled and damaged. Moreover, the length of the tube with the telescoping optics-means 4*c* is equal to the largest internal diameter of the sealing housing. Thus the shape of the light shade is restricted. This affects consumer purchase intention and operation cost in manufacturing. There is room for improvement and there is a need to provide a novel nightlight.

SUMMARY OF THE INVENTION

Therefore it is a primary object of the present invention to provide a nightlight in which light emitted is passed through at least one pattern plate and then is projected outward. Thus the light projected out is with specific pattern. The light function of the nightlight is improved and the cost is reduced.

In order to achieve the above object, a nightlight according to the present invention includes a support, a plug, a housing, a bent tube, at least one light emitting diode (LED) and a wire. The support is formed by two symmetrical axle seats each of which is disposed with an axial hole and arranged at an upper part of the support. The plug is set on a lower part of the support for connection to an external power source. The housing is composed of a chamber and two symmetrical shafts each of which is mounted on the axle seat of the support. Thus the housing can be rotated slantingly with respect to the support. The shaft is set with a shaft hole. The bent tube is mounted in the chamber of the housing and having an upper segment, a lower segment and a middle segment located between the upper segment and the lower segment. Thus the bent tube is having an angle of bending and a central axis formed therein. An opening of the upper segment is fixed on the top surface of the housing while an opening of the lower segment is disposed with a LED slot. A lens slot is arranged at the middle segment for mounting a reflective lens. At least one pattern plate and a projection lens set are mounted in the bent tube. The LED is set on the LED slot of the bent tube. Light emitted from the LED is moved along the central axis of the bent tube and passed through the projection lens set, the pattern plate and the reflective lens to be projected out. One end of the wire is connected to the plug while the other end thereof is passed through the axial hole on the axle seat of the support and the shaft hole on the shaft of the housing and entered into the chamber of the housing for connecting and providing power to the LED. Thus the nightlight can project the light with specific patterns at a certain angle. The light function of the nightlight is improved and the cost is down.

BRIEF DESCRIPTION OF THE DRAWINGS

FIG. 5 A is a partial view of the embodiment in FIG. 5 in use with a rotatable plug according to the present invention;

DETAILED DESCRIPTION OF THE PREFERRED EMBODIMENTS

Figure 2:
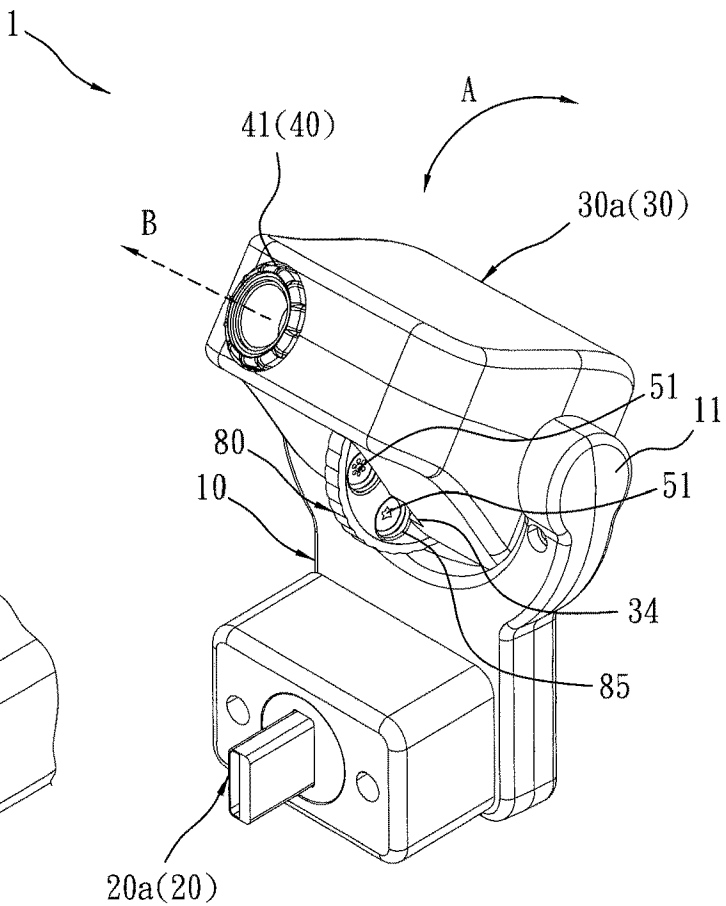
FIG. 2 is a perspective view of the embodiment in FIG. 1 with a rotatable housing according to the present invention.

Refer to FIG. 1, FIG. 3, FIG. 5 and FIG. 7, a nightlight 1 of the present invention includes a support 10, a plug 20, a housing 30, a bent tube 40, at least one light emitting diode (LED) 60 and a wire 70.

Figure 1A:
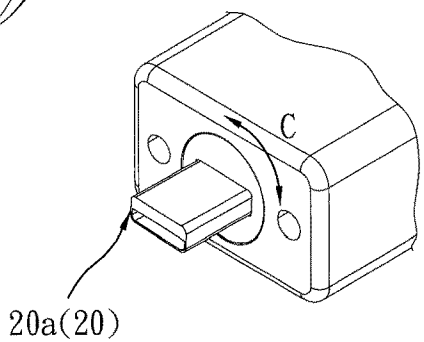
FIG. 1A is a partial view of the embodiment in FIG. 1 in use with a rotatable plug according to the present invention.
Figure 5A:
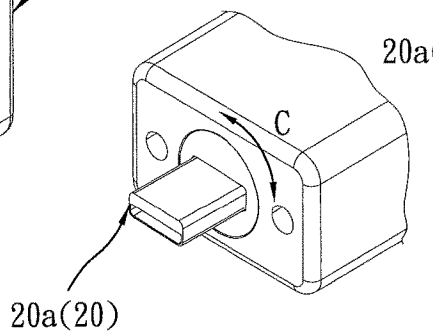
FIG. 5 is a perspective view of another embodiment including a spherical housing and a standard USB plug according to the present invention.
Figure 5:
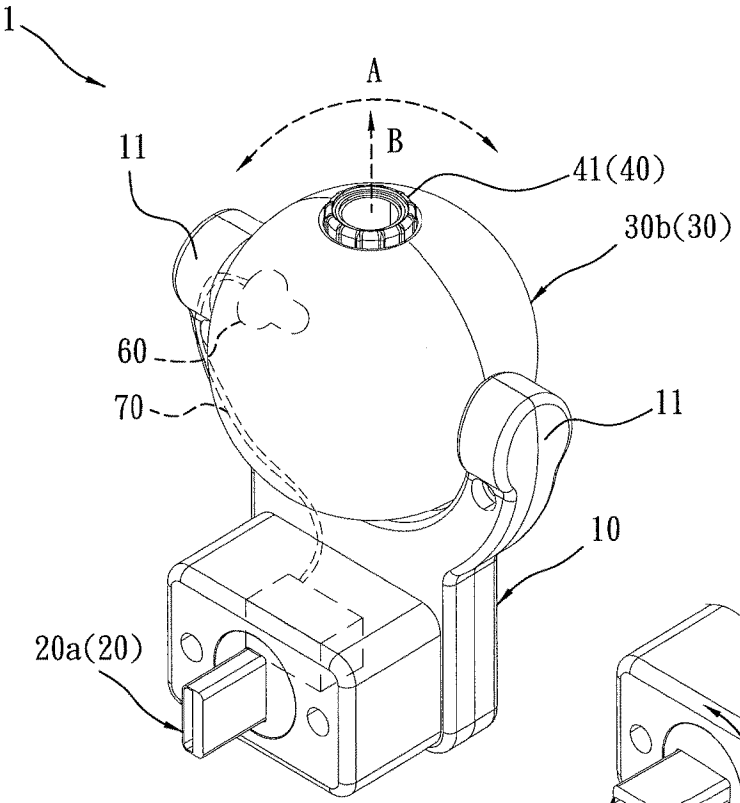
Figure 13:
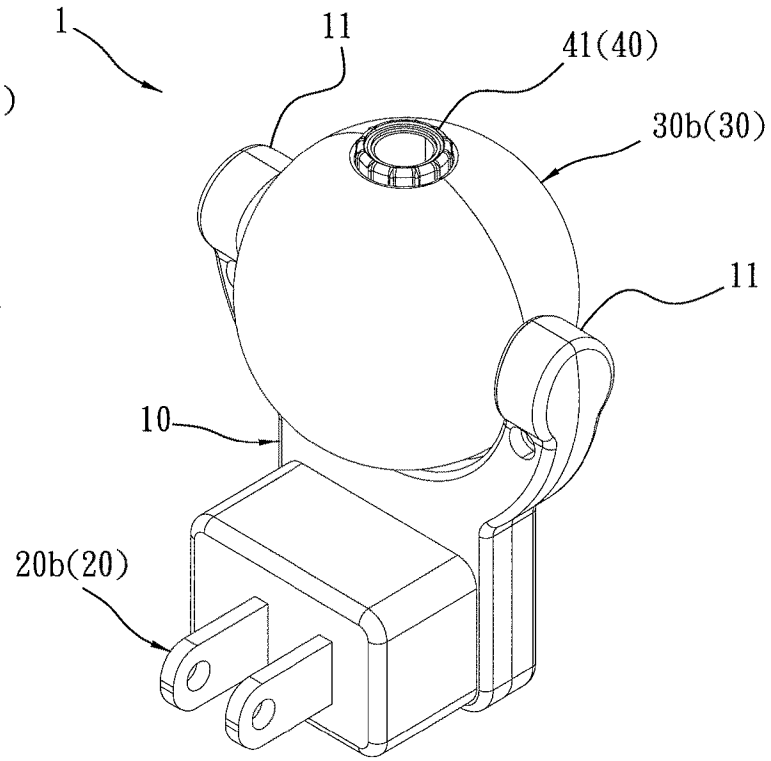
FIG. 13 is a perspective view of a further embodiment with a spherical housing and a US plug according to the present invention.
Figure 12:
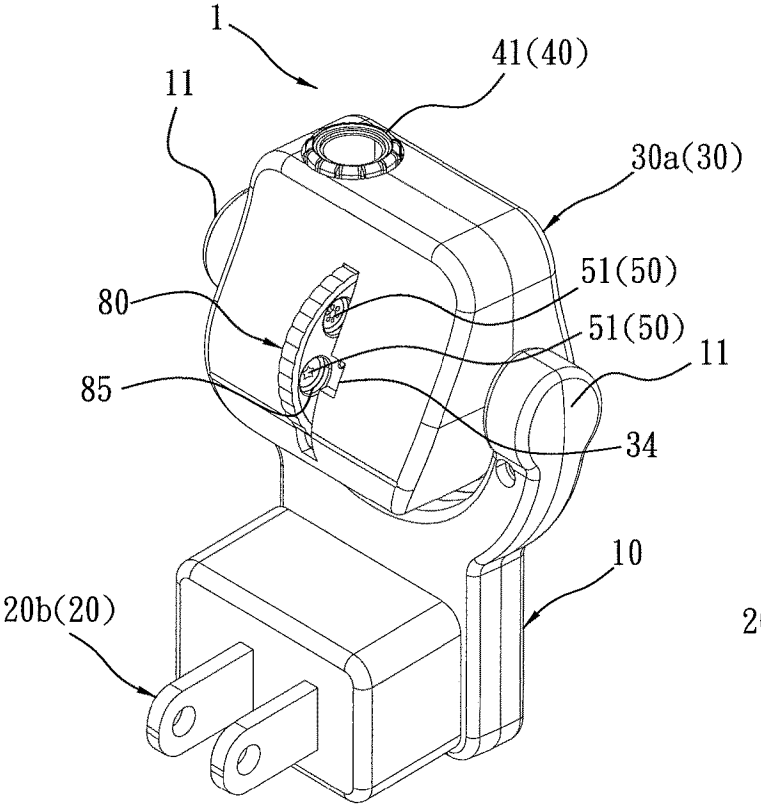
FIG. 12 is a perspective view of a further embodiment with a rectangular housing and a US plug according to the present invention.
Figure 15:
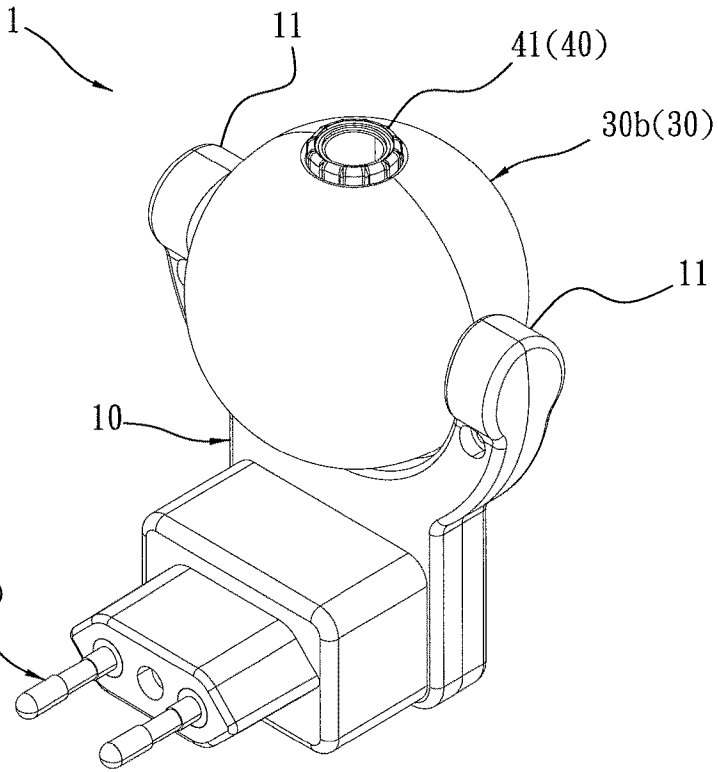
FIG. 15 is a perspective view of a further embodiment with a spherical housing and an EU plug according to the present invention.
Figure 14:
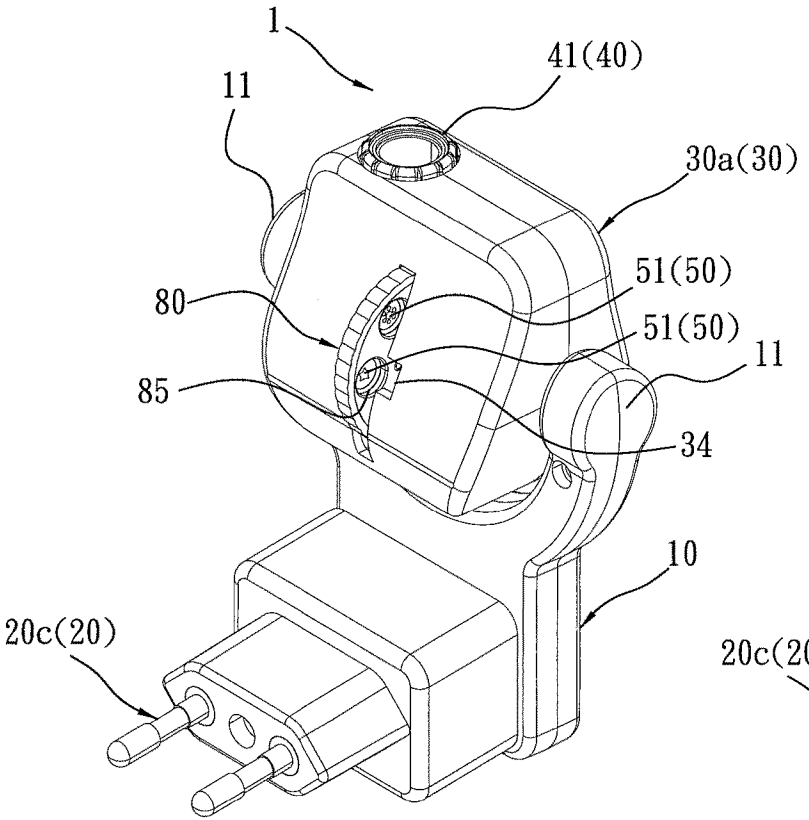
FIG. 14 is a perspective view of a further embodiment with a rectangular housing and an EU plug according to the present invention.

The support 10 consists of two symmetrical axle seats 11 on an upper part thereof, and an axial hole 12 disposed on each axle seat 11. The plug 20 is arranged at a lower part of the support 10 for connection to an external power source and is able to be a USB (Universal Serial Bus) plug 20*a* (as shown in FIG. 1-3, FIG. 5-7, FIG. 9, and FIG. 11), a US plug 20*b* (as shown in FIG. 12 and FIG. 13) or an EU plug 20*c* (as shown in FIG. 14 and FIG. 15), but not limited. The US plug 20*a* can be a standard size (shown in FIG. 1-3 and FIG. 5-7) or miniature size (shown in FIG. 9 and FIG. 11). Thus the nightlight can be used in different areas and countries. When the plug 20 is a USB plug, the plug 20 can be rotated within 90 degrees between the vertical and horizontal directions, as the arrow C in FIG. 1A and FIG. 5A indicates. Thus the nightlight 1 can be used for different space.

The housing 30 is composed of a chamber 31, two symmetrical shafts 32 and two shaft holes 33 set on the shafts 32 respectively. Each shaft 32 is mounted on the axle seat 11 of the support 10 correspondingly so that the housing 30 can be rotated slantingly with respect to the support 10, as the arrow A in FIG. 2 and FIG. 6 indicates. The shape of the housing 30 is not limited. The housing 30 can be a rectangular housing 30*a* (as shown in FIG. 1-3, FIG. 9, FIG. 12, and FIG. 14) or a spherical housing 30*b* (as shown in FIG. 5-7, FIG. 11, FIG. 13 and FIG. 15). Thus users have more options owing to different shapes of the nightlight 1.

Figures 3, 3A:
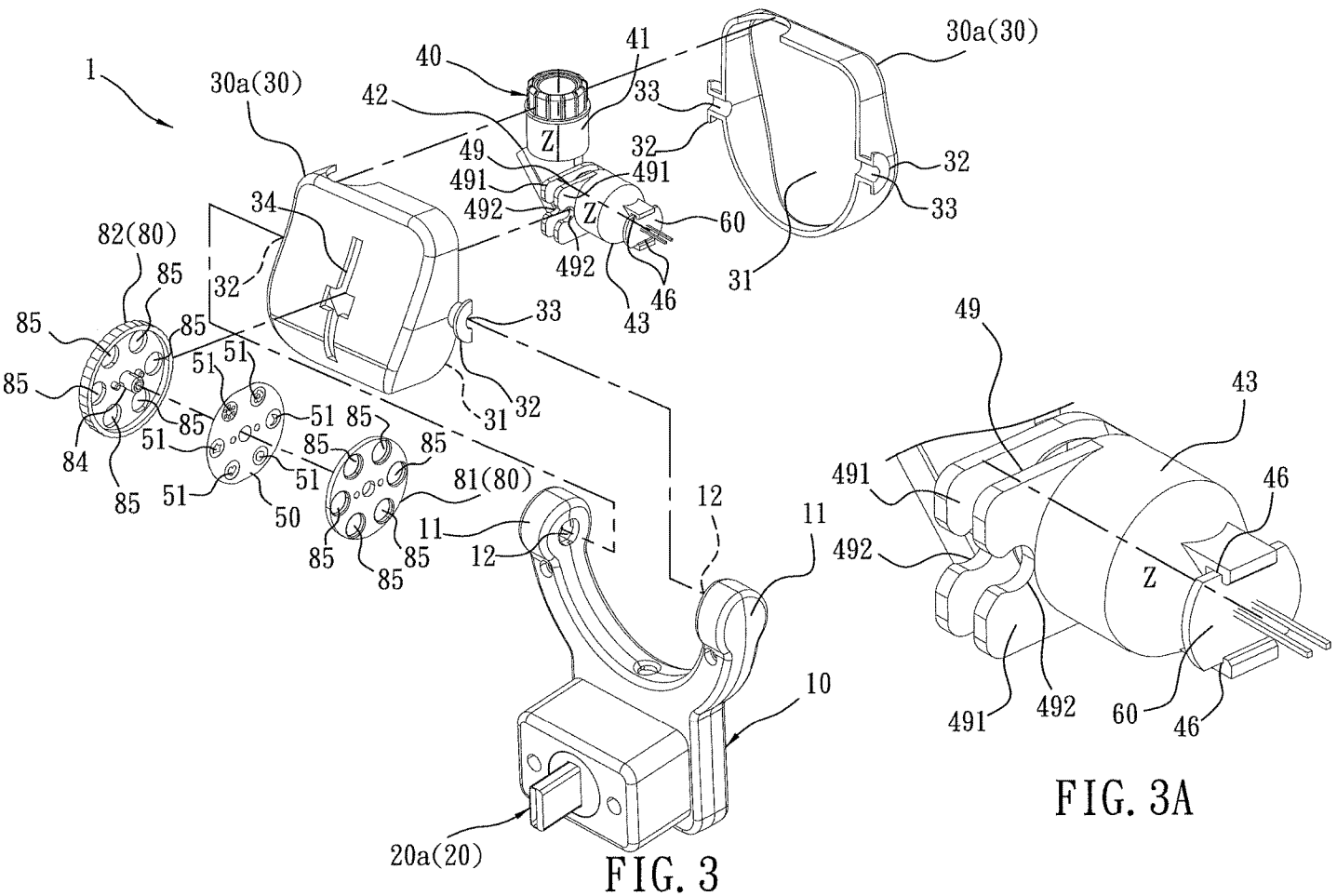
FIG. 3 is an explosive view of the embodiment according to the present invention.
FIG. 3A is a partial enlarged view of a bent tube of the embodiment in FIG. 3 according to the present invention.
Figure 3C:
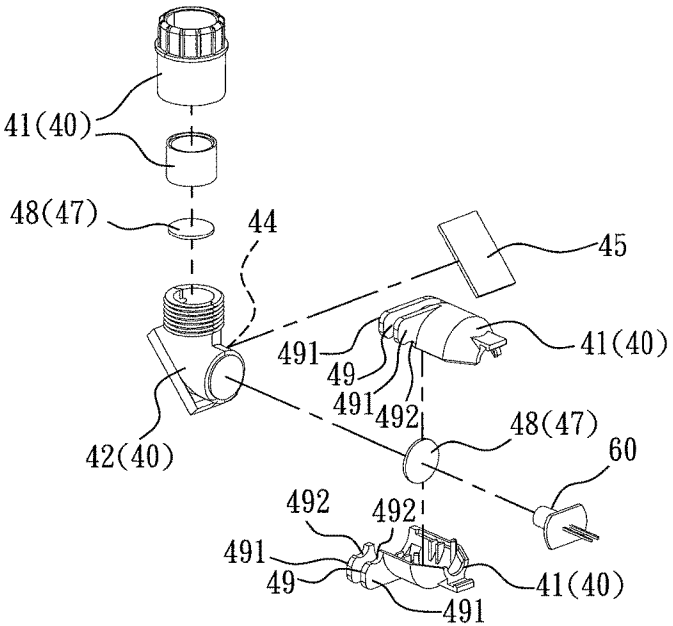
FIG. 3C is an explosive view of a bent tube of the embodiment in FIG. 3 according to the present invention.
Figure 3B:
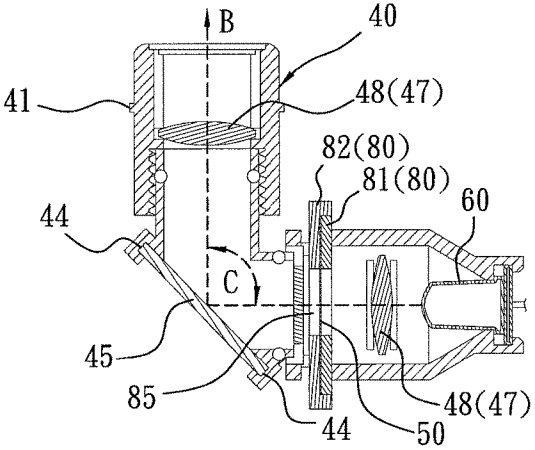
FIG. 3B is an enlarged sectional view of a bent tube of the embodiment in FIG. 3 according to the present invention.
Figure 6:
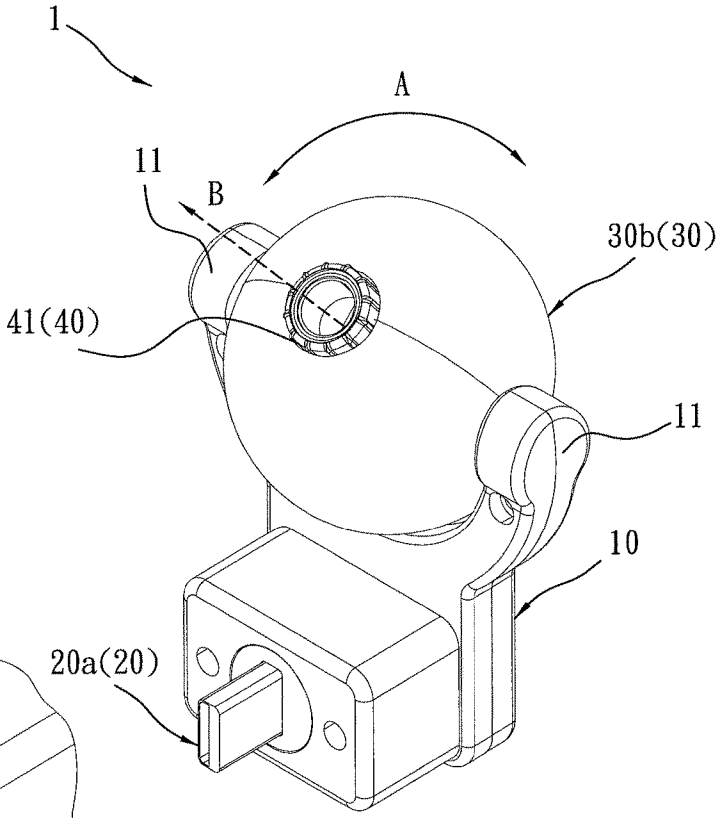
FIG. 6 is a perspective view of the embodiment in FIG. 5 in use with a rotatable housing according to the present invention.

The bent tube 40 is mounted in the chamber 31 of the housing 30 and including an upper segment 41, a lower segment 43 and a middle segment 42 located between the upper segment 41 and the lower segment 43 as shown in FIG. 3B and FIG. 3C. Thus the bent tube 40 is having an angle of bending (as the arrow C in FIG. 3B and FIG. 7A indicates) and a central axis (as the Z axis in FIG. 3 and FIG. 7 indicates) formed therein. An opening of the upper segment 41 is fixed on the top surface of the housing 30 while a lens slot 44 is arranged at the middle segment 42 and used for mounting a reflective lens 45, as shown in FIG. 3A and FIG. 3B. An opening of the lower segment 43 is disposed with a LED slot 46. The angle of bending formed among the upper segment 41, the middle segment 42 and the lower segment 43 can be, but not limited to, 90 degrees. The design of the bent tube 40 minimized the space the bent tube 40 occupied in the chamber 31 of the housing 30. The less the shape of the housing 30 is limited, the greater variability the design of the housing 30 exhibits.

Figure 4:
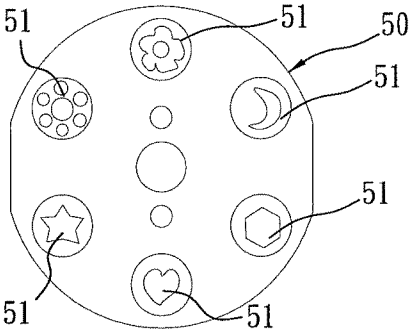
FIG. 4 is a right side view of a pattern plate with various patterns of an embodiment according to the present invention.

As shown in FIG. 3B and FIG. 4, at least one pattern plate 50 and a projection lens set 47 are mounted in the bent tube 40. The projection lens set 47 includes at least one lens 48 that is able to be arranged at the upper segment 41 and the lower segment 43, as shown in FIG. 3C and FIG. 7B respectively.

Figures 7, 7A, 7B, 8:
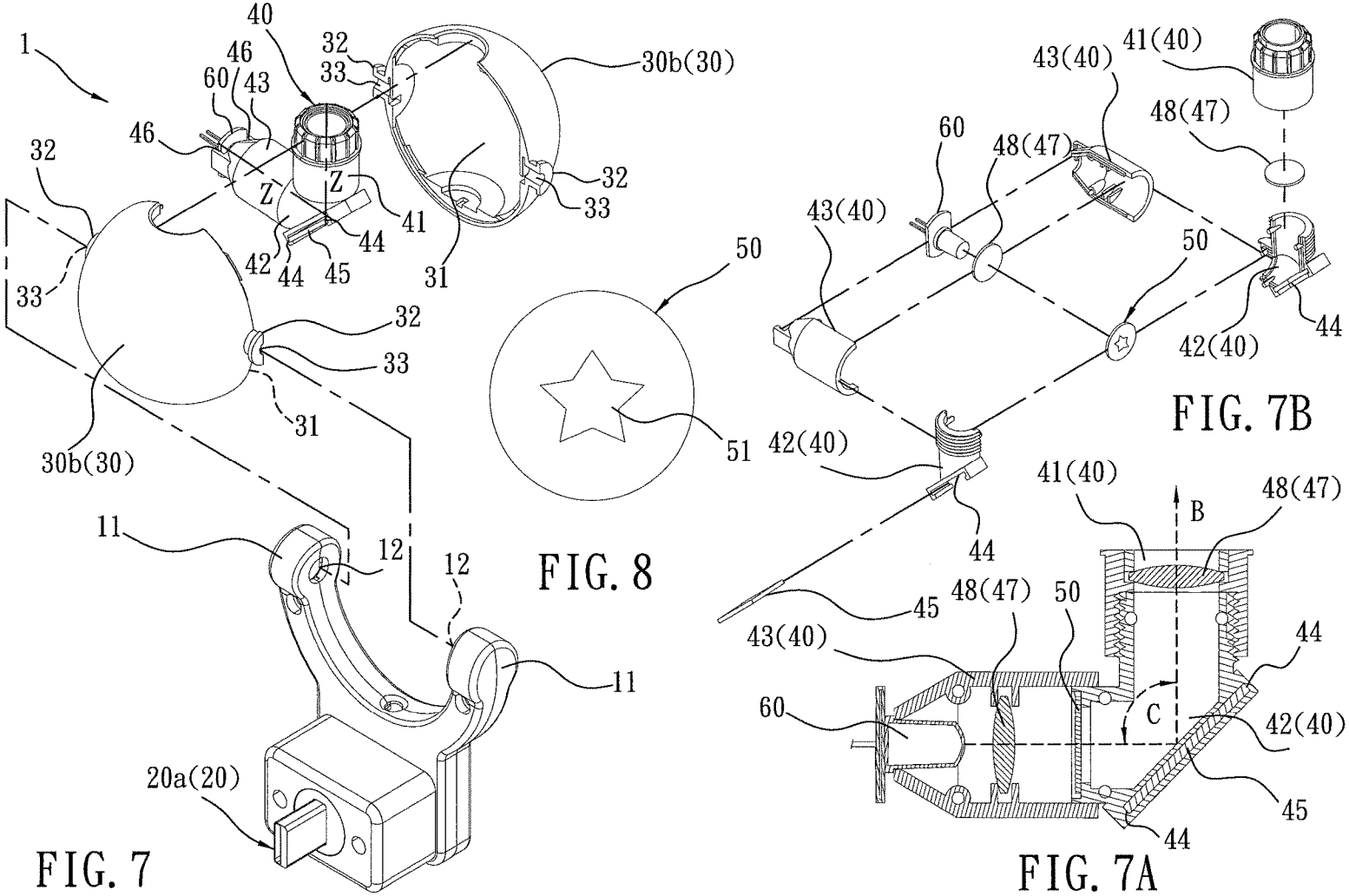
FIG. 7 is an explosive view of the embodiment in FIG. 5 according to the present invention.
FIG. 7A is an enlarged sectional view of a bent tube of the embodiment in FIG. 7 according to the present invention.
FIG. 7B is an explosive view of a bent tube of the embodiment in FIG. 7 according to the present invention.
FIG. 8 is a right side view of a pattern plate of an embodiment according to the present invention.

The LED 60 is set on the LED slot 46 of the bent tube 40, as shown in FIG. 3B and FIG. 7A. Light emitted from the LED 60 is moved along the central axis of the bent tube 40 (the Z axis in FIG. 3 and FIG. 7), and passed through the projection lens set 47, the pattern plate 50 and the reflective lens 45 to be projected outward, as the arrow B in FIG. 1, FIG. 2, FIG. 3B, FIG. 5, FIG. 6, and FIG. 7A indicates. The pattern plate 50 is a transparency film printed with patterns, able to be mass-produced and used for image enhancement.

The color of light the LED 60 emits is not limited, able to be R (red), G (green), B (blue), or others of the mixed light such as yellow, white, etc. Users can choose what they need.

One end of the wire 70 is connected to the plug 20 while the other end thereof is passed through the axial hole 12 on the axle seat 11 of the support 10 and the shaft hole 33 on the shaft 32 of the housing 30 and entered into the chamber 31 of the housing 30 for connecting and providing power to the LED 60. The LED 60 is rotated coaxially with the axial hole 12 and the shaft hole 33 so that the wire 70 will not be rotated along with the housing 30 and damaged easily while users rotate the housing 30. Thus the service life of the nightlight 1 is extended.

Figure 1:
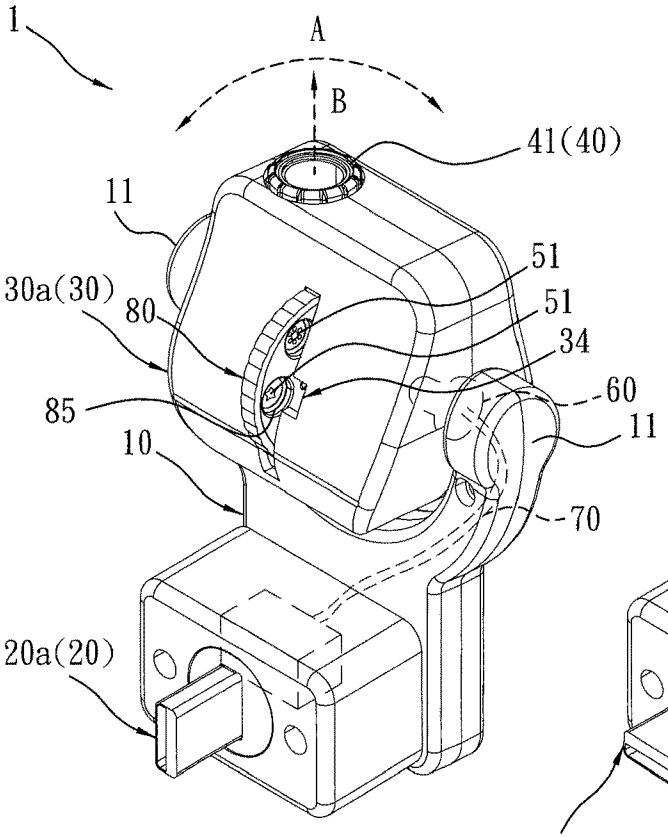
FIG. 1 is a perspective view of an embodiment having a rectangular housing in combination with a USB (Universal Serial Bus) plug according to the present invention.

Refer to FIG. 1, FIG. 2 and FIG. 3, the housing 30 is further disposed with an outer radial slot 34 that is perpendicular to the central axis (the Z axis in FIG. 3 and FIG. 7) of the upper segment 41 of the bent tube 40 while the bent tube 40 in the housing 30 is arranged with an inner radial slot 49 corresponding to the outer radial slot 34 (as shown in FIG. 3A and FIG. 3C). The inner radial slot 49 is located on the lower segment 43 of the bent tube 40 and having two vertical lugs 491 outside thereof. The vertical lugs 491 are parallel to each other and set with a base 492 respectively.

As shown in FIG. 1-3, FIG. 9 and FIG. 10, the nightlight 1 further includes a rotary disc 80 that is composed of a cover part 81, a base part 82, a left shaft 83, a right shaft 84 and a plurality of through holes 85. The rotary disc 80 is moveably mounted into the outer radial slot 34 of the housing 30 and the inner radial slot 49 of the bent tube 40 while the left shaft 83 and the right shaft 84 of the rotary disc 80 are stopped on the bases 492 of the bent tube 40 respectively. Thus the rotary disc 80 is rotating on the lugs 491. About a half part of the rotary disc 80 is exposed outside the outer radial slot 34 of the housing 30 for being rotated by users.

Refer to FIG. 1-4 and FIG. 9, the pattern plate 50 is disposed with a plurality of patterns 51 arranged circularly and corresponding to the through holes 85 of the rotary disc 80 respectively. The patterns 61 are aligned with the central shaft of the bent tube 40 when the rotary disc 80 is rotated. The pattern plate 50 is disposed between the cover part 81 and the base part 82 of the rotary disc 80 so that the pattern plate 50 is enclosed by the cover part 81 and the base part 82, without falling off easily.

Figures 9, 10, 11:
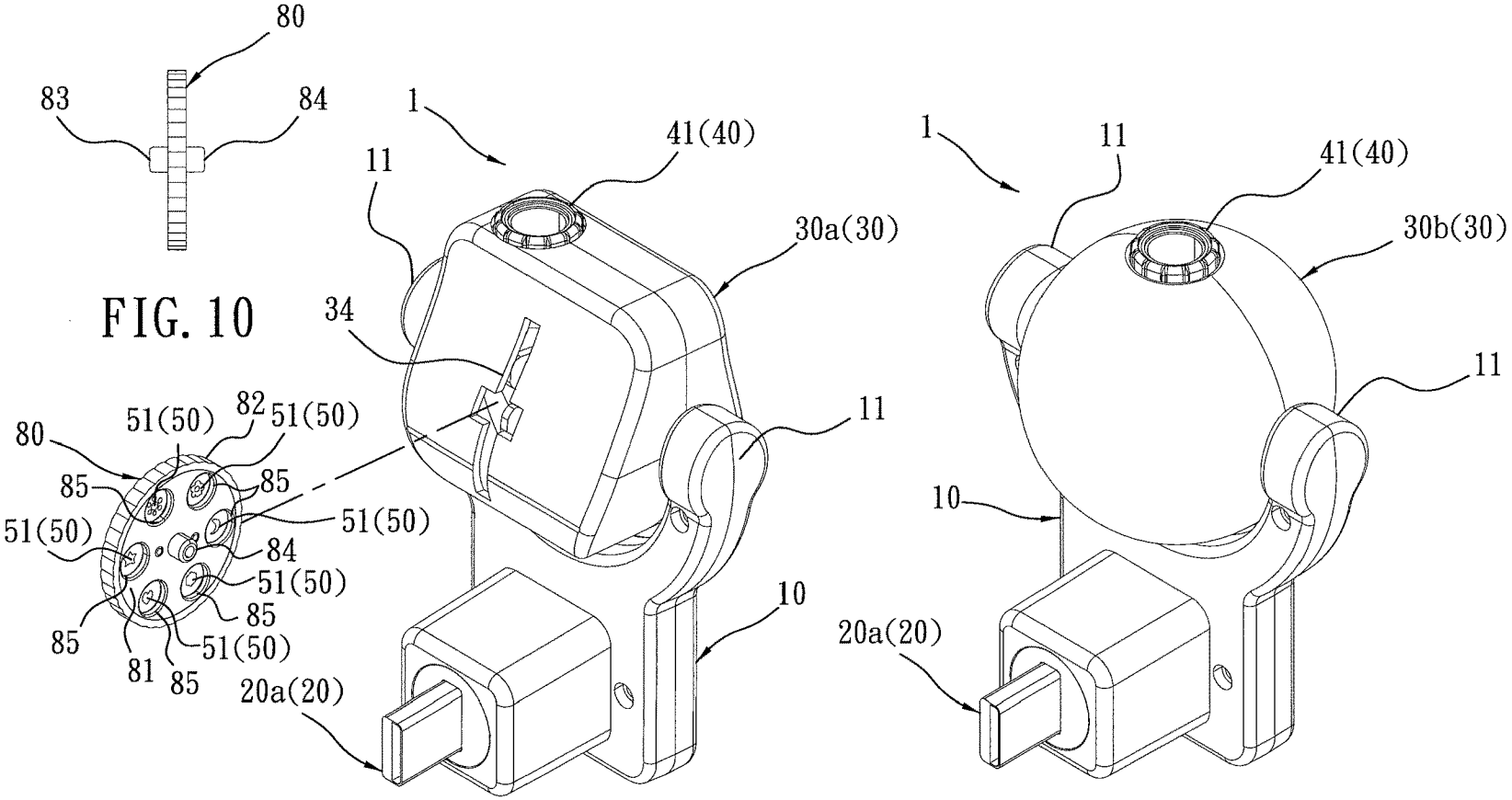
FIG. 9 is a perspective view of a further embodiment with a rectangular housing and a miniature type USB plug according to the present invention.
FIG. 10 is a front view of a rotary disc of an embodiment according to the present invention.
FIG. 11 is a perspective view of a further embodiment with a spherical housing and a miniature type USB plug according to the present invention.

Refer to FIG. 1, FIG. 2, FIG. 5, and FIG. 6, the user can change the angle of the light being projected (as the arrow A in the figures indicates) by rotating the housing 30. Thus the light with one of the patterns 51 (as shown in FIG. 4 and FIG. 8) is projected to different places such as the ceiling, the whiteboard, the blackboard, the ground, etc. While adjusting the angle of the light projected, the user can also rotate the rotary disc 80 to select the pattern 51 they need and project the light with different patterns 51 once the nightlight 1 is disposed with the rotary disc 80. Refer to FIG. 9, the rotary disc 80 can be mounted into or removed from the nightlight 1 freely. Thus manufactures or users can replace or select the rotary disc 80 with different patterns 51 easily according to their needs. Thus the users have more options on the patterns 51 of the light the nightlight 1 emits. The light function of the nightlight 1 is further enhanced.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A nightlight comprising:

a support having two symmetrical axle seats each of which is disposed with an axial hole and arranged at an upper part of the support;

a plug that is set on a lower part of the support for connection to an external power source;

a housing that includes a chamber and two symmetrical shafts each of which is mounted on the axle seat of the support so that the housing is able to be rotated slantingly with respect to the support; each of the shafts having a shaft hole;

a bent tube that is mounted in the chamber of the housing and including an upper segment, a lower segment and a middle segment located between the upper segment and the lower segment; thus the bent tube is having an angle of bending and a central axis formed therein; an opening of the upper segment is fixed on the top surface of the housing and a lens slot is arranged at the middle segment for mounting a reflective lens while an opening of the lower segment is disposed with a LED slot; at least one pattern plate and a projection lens set are mounted in the bent tube;

at least one LED is set on the LED slot of the bent tube; light emitted from the LED is moved along the central axis of the bent tube and passed through the projection lens set, the pattern plate and the reflective lens to be projected out; and a wire having one end thereof connected to the plug and the other end thereof passed through the axial hole on the axle seat of the support and the shaft hole on the shaft of the housing and entered into the chamber of the housing for connecting and providing power to the LED.

2. The device as claimed in claim 1, wherein the angle of bending among the upper segment, the middle segment and the lower segment of the bent tube is 90 degrees.

3. The device as claimed in claim 1, wherein the plug is selected from the group consisting of a USB (Universal Serial Bus) plug, a US plug, and an EU plug.

4. The device as claimed in claim 3, wherein the plug is able to be rotated within 90 degrees between vertical and horizontal directions when the plug is the USB plug.

5. The device as claimed in claim 1, wherein the housing is selected from the group consisting of a rectangular housing and a spherical housing.

6. The device as claimed in claim 1, wherein the housing is further disposed with an outer radial slot that is perpendicular to the central axis of the upper segment of the bent tube while the bent tube in the housing is arranged with an inner radial slot corresponding to the outer radial slot; the inner radial slot is located on the lower segment of the bent tube and having two vertical lugs outside thereof; the vertical lugs are parallel to each other and set with a base respectively.

7. The device as claimed in claim 6, wherein the nightlight further includes a rotary disc; the rotary disc is having a cover part, a base part, a left shaft, a right shaft and a plurality of through holes; the rotary disc is moveably mounted into the outer radial slot of the housing and the inner radial slot of the bent tube while the left shaft and the right shaft of the rotary disc are stopped on the bases of the bent tube respectively so that the rotary disc is rotating on the lugs; a half part of the rotary disc is exposed outside the outer radial slot of the housing.

8. The device as claimed in claim 7, wherein the pattern plate is disposed with a plurality of patterns arranged circularly and corresponding to the through holes of the rotary disc respectively; the patterns are aligned with the central shaft of the bent tube when the rotary disc is rotated; the pattern plate is disposed between the cover part and the base part of the rotary disc.

9. The device as claimed in claim 1, wherein the projection lens set is having at least one lens that is able to be mounted in the upper segment and the lower segment.

10. The device as claimed in claim 1, wherein the pattern plate is a transparency film printed with patterns.

* * * * *